United States Patent [19]

Tsukuda et al.

[11] Patent Number: 4,614,929

[45] Date of Patent: Sep. 30, 1986

[54] METHOD FOR MANUFACTURE OF MAGNET

[75] Inventors: Takaaki Tsukuda; Toyohiko Hata, both of Sano; Akira Fujisaki, Tanuma, all of Japan

[73] Assignee: Nihon Radiator Co., Ltd., Tokyo, Japan

[21] Appl. No.: 715,501

[22] Filed: Mar. 25, 1985

[30] Foreign Application Priority Data

Mar. 30, 1984 [JP] Japan ..... 59-61162

[51] Int. Cl.[4] ..... H01F 13/00

[52] U.S. Cl. ..... 335/284; 361/143

[58] Field of Search ..... 335/284, 302, 303; 361/143; 29/607

[56] References Cited

U.S. PATENT DOCUMENTS 3,139,567 6/1964 Atkinson ..... 335/284

FOREIGN PATENT DOCUMENTS 152200 11/1979 Japan ..... 335/284

*Primary Examiner*—George Harris

[57] ABSTRACT

A method for the manufacture of an annular magnet, which comprises depositing, on the opposite sides of an annular material of magnetic substance, magnetizing members regularly spaced circumferentially in conformity with the shape of said annular material and opposed perpendicularly to each other across said annular material and forming magnetic fluxes through paired magnetizing members in alternately opposite directions thereby magnetizing said interposed annular material.

4 Claims, 7 Drawing Figures

MAGNETIC FLUX DISTRIBUTION

MAGNETIC FLUX DISTRIBUTION

METHOD FOR MANUFACTURE OF MAGNET

BACKGROUND OF THE INVENTION

1. Field of the Invention

This invention relates to a method for the manufacture of a magnet. More particularly, this invention relates to improvements in and concerning a method for the manufacture of a magnet by the magnetization of an annular material prepared for magnetization.

2. Description of the Prior Art

Generally, in flat motors and other similar electric devices, an annular magnetized shaped article of magnetic material (such as barium ferrite, $SmCo_5$ or Alnico) of a relatively small wall thickness, which is called a ring magnet, is used.

The annular magnet of this class is magnetized, as illustrated in FIG. 1, for example, by setting an annular material 12 for magnetization in place on a base 14 as fixed to a yoke 10, applying a magnetizing member 16 hung down from above on the surface of the material 12, and energizing a coil 18 wound on the magnetizing member 16. This magnetizing member 16 comprises a core member of magnetic material (actually an iron core) 18 and one magnetizing coil 20 wound up in alternately opposite directions on the core member, particularly the projected parts 18*a* and 18*b* thereof.

When the magnetization is effected only on one side of the annular material as described above, however, there is produced a magnet $M_1$ having narrow intermediate zones 22 interposed between adjacent S poles and N poles as illustrated in FIG. 2, partly because the projected parts 18*a* and 18*b* of the core member 18 are separated from each other only by a small distance. If the magnet $M_1$ of this nature is incorporated in a rotary machine such as the flat motor, there is the possibility that the device will generate electromagnetic vibration when it is set rotating. By the term "electromagnetic vibration" as used herein is meant the vibration which occurs because the magnetic attraction manifested by adjacent S and N poles is altered when a live armature passes a point of magnetic flux shift from an S pole to an N pole, for example. It forms a possible cause for motor noise and degradation of motor performance.

As a remedial measure, the practice of carrying out magnetization while fixing the distance, d, between the projected parts 18*a* and 18*b* of the magnetizing member 16 at a prescribed length as illustrated in FIG. 3 has found popular acceptance. Despite this contrivance, the magnetic flux induces interference between adjacent poles because the magnetic flux, in the presence of electric current, flows from the S pole of the annular material 12 through the yoke 10 to the N pole of the annular material 12, making a U-turn flow inside the annular material 12. As the result, the parts which should form neutral zones 24 are actually magnetized as indicated by hatching as illustrated in FIG. 4. Thus, with the ring magnet $M_1$, it is difficult to obtain parts ideally devoid of magnetic flux. This imperfect absence of magnetic flux in these parts may be blamed for the motor noise and the degradation of motor performance.

Recently, therefore, a split magnet $M_2$ which has intervening neutral zones 24 formed positively as illustrated in FIG. 5 has come to find acceptance. Since the split magnet $M_2$ necessitates attachment of a multiplicity of magnets 12 independently to the yoke 10, it entails operational incoveniences from the standpoint of manufacture and inevitably proves expensive.

An object of this invention is to provide a novel method for the manufacture of a magnet.

Another object of this invention is to provide an improved method for the manufacture of a magnet by the magnetization of an annular material.

Yet another object of this invention is to provide a method for the manufacture of a magnet, which ensures formation of sharply defined neutral zones without any sacrifice of the ease of fabrication enjoyed by the ring magnet.

SUMMARY OF THE INVENTION

The various objects described above are attained by a method for the manufacture of an annular magnet, which comprises depositing, on the opposite sides of an annular material of magnetic substance, magnetizing members regularly spaced circumferentially in conformity with the shape of the annular material and opposed perpendicularly to each other across the annular material and forming magnetic fluxes through paired magnetizing members in alternately opposite directions thereby magnetizing the interposed annular material.

EXPLANATION OF PREFERRED EMBODIMENT

Now, one working example of the method of this invention will be described in detail below with reference to the accompanying drawings.

Figure 1:
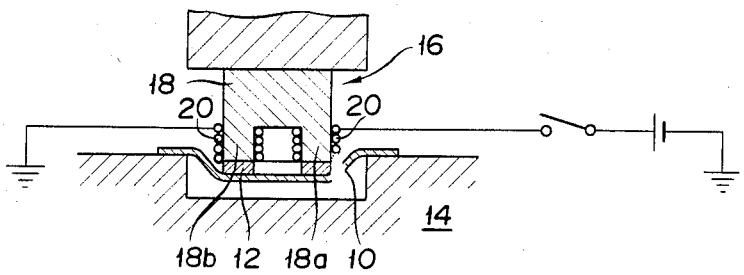
FIG. 1 (PRIOR ART)
FIG. 1 is a schematic cross sectional view illustrating a conventional method for the magnetization of a magnet.
Figure 2:
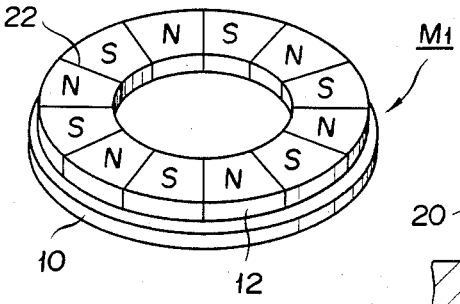
FIG. 2 (PRIOR ART)
FIG. 2 is a perspective view illustrating a magnet to be obtained by the method of FIG. 1.
Figure 3:
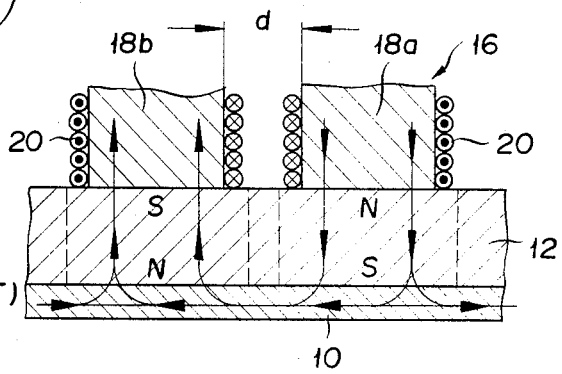
FIG. 3 (PRIOR ART)
FIG. 3 is an enlarged schematic cross sectional view illustrating the essential part of an apparatus used for the conventional method of magnetization.
Figure 4:
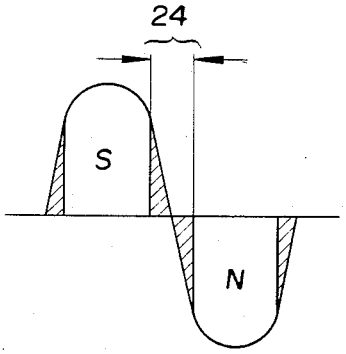
FIG. 4 (PRIOR ART)
FIG. 4 is a diagram showing the magnetic flux distribution is a magnet manufactured by the conventional method of magnetization.
Figure 5:
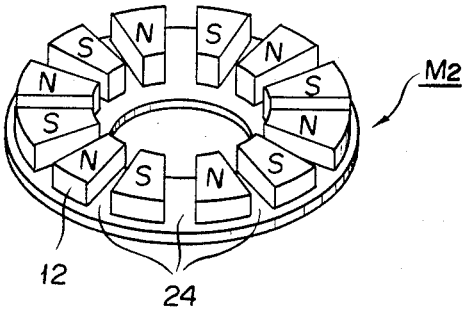
FIG. 5 (PRIOR ART)
FIG. 5 is a perspective view illustrating another magnet of the conventional principle.
Figure 6:
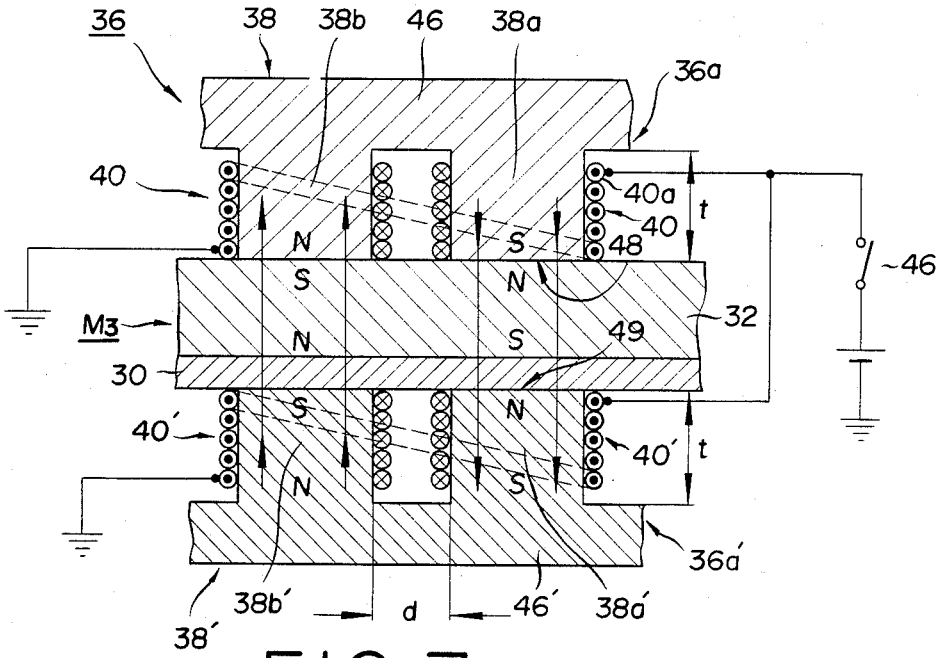
FIG. 6 is an enlarged cross sectional view illustrating the essential part of an apparatus used for the method of the present invention.

FIG. 6 is a cross sectional view illustrating the condition in which magnetization is effected by the method of this invention. The magnetizing members 36 to be used in the method of this invention comprise an upper group of magnetizing members 36*a* and a lower group of magnetizing members 36*a'*, which are so disposed as to be perpendicularly opposed to each other across a prescribed distance and paired off. In each of the groups, the individual magnetizing members which are in an even number are regularly spaced circumferentially.

The upper magnetizing members 36*a* and the lower magnetizing members 36*a'* alike are provided with a core member (such as, for example, an iron core) 38 (38') and a magnetizing coil 40 (40'). The core member 38 (38') is provided with a plurality of projected parts 38*a* and 38*b* (38*a'* and 38*b'*) protruding to a prescribed length, t, from a plate-like base (such as, for example, a circular base) 46 (46') and a magnetizing coil 40 (40') which is formed by winding one conductor wire alternately on the aforementioned projected parts 38*a* and 38*b* (38*a'* and 38*b'*). The magnetizing coil 40 (40'), for the purpose of producing a singleside multipole constructions, is wound in a pattern such that the adjacent plies of winding coil run in opposite directions. Their directions are identical between the opposed projected parts 38*a* and 38*b* (38*a'* and 38*b'*). Particularly, the opposed projected parts 38*a* and 38*b* (38*a'* and 38*b'*) share one identical cross-sectional shape and the two magnetizing members 36*a* and 36*a'* share one identical cross-sectional shape in the horizontal direction of the annular material being magnetized. When these two magnetizing members 36*a* and 36*a'* are so disposed as to hip the annular material 32, the magnetic fluxes generated on energization directed to either of the magnetizing members 36*a*, 36*a'* are allowed to penetrate the annular material 32.

The projected parts 38*a* and 38*b* and 38*a'* and 38*b'* respectively of the core members 38 and 38' are disposed as regularly spaced by a prescribed distance. This distance, d, is such that in consequence of magnetization, the magnetized annular member will form neutral zones 44 of a width equaling this distance.

The annular material 32 for magnetization is an integrally formed annular article. Although the height of this annular material is not specifically defined, the annular material is magnetized particularly efficiently when it has a rather flat shape. This invention does not discriminate the annular material by the kind of substance used therefor. Examples of the annular material usable for magnetization by the method of this invention include ferrite magnets represented by th formula, $MO.6Fe_2O_3$ (M: Sr, Ba, Pb, etc.), rare earth-cobalt magnets represented by the formula, $RCo_5$ and $R_2Co_{17}$ (R: Sm, Y, La, Ce, etc.), manganese-bismuth magnet, manganese-aluminum magnet, and cobalt magnets (such as Al-Ni-Co type and Fe-Cr-Co type) which are invariably in a state yet to be magnetized.

To be magnetized by the use of the magnetizing members 36*a* and 36*a'* the annular material 32 is desirably mounted on the lower magnetizing member 36*a'* as attached to a yoke 30. Then, the upper magnetizing member 36*a* is lowered until the two magnetizing members 36*a* and 36*a'* nip the annular material 32. After the annular material 32 has been so nipped, a power source switch 46 is turned on to energize the magnetizing coils 40, 40'. The electric current consequently started, in the coil on the projected part 38*a* on the right and side in the diagram, first flows through the first ply 40*a* on the top upwardly from below relative to the surface of the paper (indicated by the circled dot mark, · ) and, in the cross section on the opposite side of the same magnetic coil 40, flows downwardly from above relative to the surface of the paper (indicated by the circled cross, x ). By directing the flow of electric current in a pattern as described above, an S pole forms itself on the lower surface 48 of the projected part 38*a*. The electric current flows in the same pattern in the lower projected part 38*a'* which is perpendicularly opposed to the projected part 38*a*. As the result, an N ple forms itself on the upper surface 49 of the projected part 38*a* in the lower magnetizing member 36*a'*. Naturally, an S pole forms itself on the lower side.

The magnetic flux issuing from the upper magnetizing member 36*a*, therefore, experiences no intervention of the neighboring poles. Thus, magnetic fluxes of high density are allowed to pierce the annular material 32 to produce S poles where the aforementioned projected parts 38*a* and 38*a'* are held in contact with the annular material 32.

Figure 7:
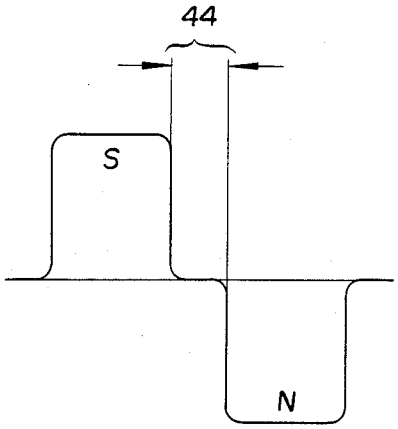
FIG. 7 is a diagram showing the magnetic flux distribution in a magnet manufactured by the method of the present invention.

The magnetization effected in the manner just described similarly takes place in all the other projected parts 38*b* and 38*b'*. The magnet $M_3$ consequetly produced by the magnetization, by test, is found to have sharply defined neutral zones 44 distributed as illustrated in FIG. 7. The magnetic force generated by each of the N and S poles is strong and free from peripheral deviation. The magnetic fluxes are distributed with high uniformity and the neutral zones 44 are in a larger width than those of the conventional countertype.

In accordance with the present invention, since the magnetizing members are perpendicularly opposed across the annular member and paired off, an annular magnet having N poles, S poles, and neutral zones clearly defined from one another can be produced with great ease and less expensively than the separate magnet.

What is claimed is:

1. A method for the manufacture of an annular magnet, which comprises depositing, on the opposite sides of an annular material of magnetic substance, magnetizing members regularly spaced circumferentially in conformity with the shape of said annular material and opposed perpendicularly to each other across said annular material and forming magnetic fluxes through paired magnetizing members in alternately opposite directions thereby magnetizing said interposed annular material.

2. A method according to claim 1, wherein said magnetizing members are formed of an even number of projected parts regularly spaced circumferentially by a fixed distance equal to the width of neutral zones to be formed in the produced magnet and said projected parts have a conductor wire wound thereon in such a manner that the electric current flows in mutually opposite directions between the adjacent projected parts.

3. A method according to claim 1, wherein said annular material is mounted on a yoke.

4. A method according to claim 1, wherein said annular material is in a flat shape.

* * * * *

UNITED STATES PATENT AND TRADEMARK OFFICE

CERTIFICATE OF CORRECTION

PATENT NO. : 4,614,929

DATED : September 30, 1986

INVENTOR(S) : Takaaki Tsukuda, Toyohiko Hata and Akira Fujisaki

It is certified that error appears in the above-identified patent and that said Letters Patent is hereby corrected as shown below:

Title Page, before "[57] ABSTRACT" and after "Primary Examiner — George Harris"; insert -- Attorney, Agent, or Firm — Gordon W. Hueschen --

Col. 2, line 1; "incoveniences" should read -- inconveniences --

Col. 3, line 5; "singleside" should read -- single-side --

Col. 3, lines 5&6; "constructions" should read -- construction --

Col. 3, line 34; "th" should read -- the --

Col. 3, line 53; "mark, · )" should read -- mark, ⊙ ) --

Col. 4, line 1; " x )." should read -- ⊗ ). --

Col. 4, line 6; "ple" should read -- pole --

Col. 4, line 7; "38a" should read -- 38a' --

Col. 4, line 19; "consequetly" should read -- consequently --

Signed and Sealed this

Twenty-fourth Day of February, 1987

*Attest:*

DONALD J. QUIGG

*Attesting Officer* *Commissioner of Patents and Trademarks*